United States Patent [19]

Ishigaki et al.

[11] 4,354,059

[45] Oct. 12, 1982

[54] VARIABLE-DIRECTIVITY MICROPHONE DEVICE

[75] Inventors: Yukinobu Ishigaki, Machida; Kaoru Totsuka, Tokyo; Makoto Yamamoto, Yokosuka; Naotaka Miyaji, Yamato, all of Japan

[73] Assignee: Victor Company of Japan, Ltd., Yokohama, Japan

[21] Appl. No.: 185,516

[22] Filed: Sep. 9, 1980

[30] Foreign Application Priority Data

| | | | |
|---|---|---|---|
| Sep. 11, 1979 | [JP] | Japan | 54-115664 |
| Oct. 8, 1979 | [JP] | Japan | 54-139390[U] |
| Nov. 12, 1979 | [JP] | Japan | 54-145356 |
| Nov. 12, 1979 | [JP] | Japan | 145357 |

[51] Int. Cl.[3] ..... H04R 1/20

[52] U.S. Cl. ..... 179/1 DM

[58] Field of Search ..... 179/1 DM

[56] References Cited

FOREIGN PATENT DOCUMENTS

| | | |
|---|---|---|
| 1274192 | 8/1968 | Fed. Rep. of Germany . |
| 2401523 | 7/1975 | Fed. Rep. of Germany . |
| 2931604 | 2/1981 | Fed. Rep. of Germany . |

*Primary Examiner*—George G. Stellar

*Attorney, Agent, or Firm*—Michael N. Meller; Anthony H. Handal

[57] ABSTRACT

A variable-directivity microphone device comprises a microphone unit having a plurality of microphones, a circuit which resultingly adds the low-frequency range components of the output signal of one of the microphones of the microphone unit and mixes with the output signal of the other microphone so that only the high-frequency range components cancel each other, and an equalizer which corrects the characteristic of the mixed signal. The above effective mixing is performed under varying mixing states.

7 Claims, 16 Drawing Figures

(dB)
RESPONSE
θ=90°
0
-10
-20
-30
ωa =10Hz
20
40
70
100
200
400
50
100
200
500
1000
2000
5000
10000
20000
FREQUENCY (Hz)

(dB)
RESPONSE
θ=0°
0
-10
-20
400
200
70
100
50
20
30
40
ωa = 10Hz
50
100
200
500
1000
2000
5000
10000
FREQUENCY (Hz)

VARIABLE-DIRECTIVITY MICROPHONE DEVICE

BACKGROUND OF THE INVENTION

The present invention relates generally to variable-directivity microphone devices, and more particularly to a variable-directivity microphone device in which the phase of the high-frequency range component of the output signal of one microphone of at least two microphones is as a result invented and this high-frequency range component is mixed to the output signal of the other microphone.

Heretofore, as a microphone device capable of varying its directivity, there has been a microphone device in which two microphones having primary sound-pressure gradient unidirectivity (hereinafter referred to as primary unidirectivity) are arranged in a mutually confronting state, and their outputs are mixed by means of a mixer. Furthermore, there has also been a microphone device in which two unidirectional microphones are arranged to face the same direction, and the output of one of the microphones is mixed with opposite phase with the output of the other microphone.

In each of these devices, the directivity of the microphone device is varied effectively, by varying the mixture ratio to obtain the final output signal.

In this case, the directional pattern P obtained by mixing the outputs of the first and second microphones, in terms of the sensitivity A of the first microphone of the two microphones, the sensitivity B of the second microphone, the angle $\theta$ between the axis 1 of both microphones and the sound source, the distance D between the first and second microphones, and the wavelength constant K, becomes as follows.

$$(1)\ P = A \cdot e^{j\omega t} \cdot \frac{1+\cos\theta}{2} - B \cdot e^{j(\omega t + KD\cos\theta)} \cdot \frac{1+\cos\theta}{2} \qquad (1)$$

When the sensitivities A and B of the first and second microphones are identical, that is, A=B, the above Eq. (1) becomes $$(2)\ P = A \cdot \frac{1+\cos\theta}{2} \cdot e^{j\omega t} \cdot \{1 - e^{j(KD\cos\theta)}\} \qquad (2)$$

By appropriately selecting the value of A in Eq. (2), a directional pattern of secondary unidirectivity can be obtained.

In this known device, however, since the outputs of the two microphones are mixed with mutually opposite phases, a dip in the frequency characteristic occurs at a frequency F corresponding to the wavelength of the picked-up sound wave when this wavelength is equal to the distance D between the front faces of the two microphones (F being 11.3 KHz, for example, when D is 3 cm.). At the same time, at a frequency where the wavelength of the sound wave is very much less than the distance D, a frequency characteristic wherein the response decreases in a proportion of 6 dB/oct with decreasing frequency is exhibited.

Accordingly, in a known microphone device, the output of the aforementioned mixer is passed through an equalizer having a characteristic which is the opposite of the above described frequency characteristic, that is, a frequency characteristic wherein the response increases with decreasing frequency. By this expedient, a signal of flat characteristic wherein the frequency characteristic has been corrected, particularly in the medium-and low-frequency ranges, is obtained from the output of the equalizer.

In a signal obtained from the above mentioned mixer, however, the response decrease in the frequency characteristics is of the order of 29 dB at 100 Hz, for example, the above mentioned equalizer must have an equalizing characteristic which carries out response correction of the order of 29 dB at 100 Hz. Consequently, for the above mentioned equalizer, an equalizer having an equalizing characteristic of great correction quantity must be used. As a result, the S/N ratio of the signal obtained from the equalizer is small, particularly in the low-frequency range. Furthermore, in the case where the microphones are used outdoors, noise due to wind in a range of relatively low-frequency is easily produced. Furthermore, the problem is that touch noise and the like in a range of relatively low-frequency is also easily produced when the microphones are touched.

SUMMARY OF THE INVENTION

Accordingly, it is a general object of the present invention to provide a new and useful variable-directivity microphone device in which the above described problems have been overcome.

Another and specific object of the invention is to provide a variable-directivity microphone device in which at least two microphones are used, and the phase of the high-frequency component in the output signal of one of these microphones is inverted, and the high-frequency component is mixed (added) with variable mixing ratio with the output signal of the other microphone.

In accordance with device of the present invention, in the high-frequency range, the resultant effect is substantially the same as that when the outputs from the two microphones are subjected to subtraction mixing, whereby a secondary unidirectional pattern can be obtained similarly as in a known device. On the other hand, in the low-frequency range, the resultant effect is substantially the same as that when the outputs from the microphones are subjected to addition mixing, whereby the output after mixing has a substantially flat frequency characteristic and may be considered to be an output from a signal microphone of a primary unidirectivity, this directivity assuming a primary unidirectional pattern. Since the response does not decrease as in a known device, the response, particularly in the low-frequency range, in the frequency characteristic can be made higher than that of the frequency characteristic of a known device wherein the outputs of primary unidirectional microphones are merely subjected to only subtraction mixing. For this reason, the correction quantity of an equalizer for correcting the frequency so as to obtain a flat frequency characteristic of the signal after mixing, can be set at a low value, whereby the S/N ratio can be made higher than those of the prior art.

Another object of the invention is to provide a variable-directivity microphone device in which at least two microphones are employed, and the output signal of one of these microphones is passed through a variable phase shifter to invert the phase of the high-frequency range component thereof, this component then being added to the output signal of the other microphone.

Still another object of the invention is to provide a variable-directivity microphone device in which at least two microphones are used, the output signal of one of the microphones is passed through a high-pass filter, and the output signal thus obtained is mixed with (subtracted from) the output signal of the other microphone with variable mixing ratio.

A further object of the invention is to provide a variable-directivity microphone device in which at least two microphones are used, the output signal of one of the microphones is passed through a variable high-pass filter, and the output signal thus obtained is mixed with (subtracted from) the output signal of the other microphone as it is.

Other objects and further features of the present invention will be apparent from the following detailed description with respect to the preferred embodiments of the invention when read in conjunction with the accompanying drawings.

DETAILED DESCRIPTION

Figure 1:
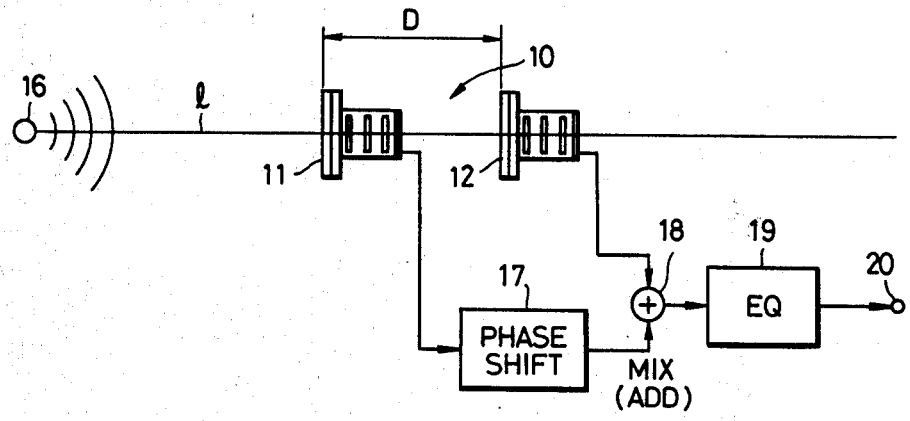
FIG. 1 is a systematic block diagram of a first embodiment of a variable-directivity microphone device of the present invention.
Figure 2:
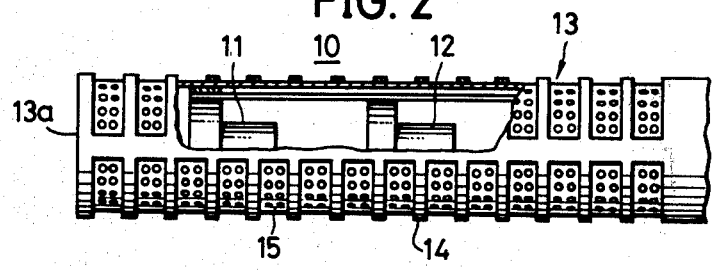
FIG. 2 is a side view, with parts cut away, of one example of a microphone unit.

In FIGS. 1 and 2, a pair of primary unidirectivity microphones 11 and 12 are arranged facing a front side 13*a* of a cylinder 13 so that their respective center axis lines coincide with a line l. The cylinder 13 comprises a frame 14 which has a plurality of openings, and a punching metal 15 provided in the inner periphery and front surfaces of the frame 14. The distance D between the vibrating plates of the microphones 11 and 12 is set, for example, at 3 centimeters.

When the center axis line l of a microphone unit 10 is aimed towards a sound source 16, the output signal of the microphone 11 is supplied to a mixer (adder) 18 through a phase-shifter 17. On the other hand, the output signal of the microphone 12 is supplied to the mixer 18 and mixed (added) with the signal of the phase-shifter 17 in the same phase. The mixer 18 varies the ratio between the signal from the phase-shifter 17 and the output signal from the microphone 12, and is organized to add these signals.

Figure 3:
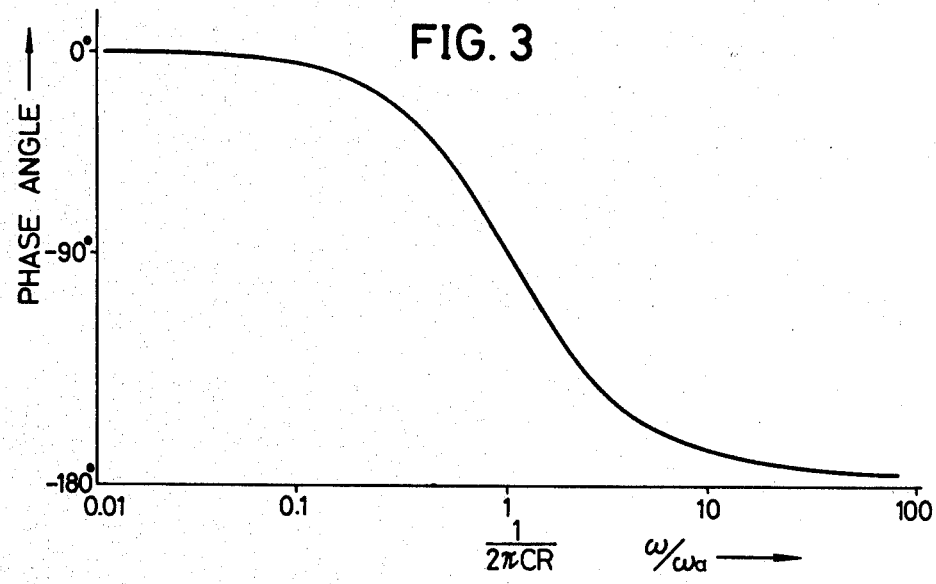
FIG. 3 is a graph showing the phase characteristic of a phase-shifter in the systematic block diagram of FIG. 1.
Figure 4:
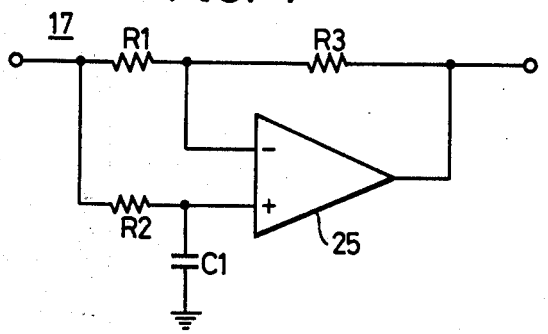
FIG. 4 is a circuit diagram showing one embodiment of a phase-shifter.

The phase-shifter 17 comprises, for example, an operational amplifier 25 connected as shown in FIG. 4, resistors $R_1$ through $R_3$, and a capacitor $C_1$, and possesses a phase characteristic as shown in FIG. 3. This phase characteristic shows on the frequency axis, the phase-shift larger than −90 degrees towards the −180 degrees direction as the ratio $\omega/\omega_a$ of the angular frequency $\omega$ and the angular frequency $\omega_a$ which lags the angular frequency $\omega$ becomes larger than unity (1), and the phase-shift smaller than −90 degrees towards the 0 degree direction as the ratio $\omega/\omega_a$ becomes less than unity. Accordingly, among the signals passed through the phase-shifter 17, the signal component in the frequency band range (high-frequency band range) where the ratio $\omega/\omega_a$ is larger than unity is phase-shifted by 180 degrees, and the signal component in the frequency range (low-frequency range) where the ratio $\omega/\omega_a$ is less than unity is hardly phase-shifted.

Therefore, as far as the high-frequency range component is concerned, the output of the microphone 11 is phase-inverted and added to the output of the microphone 12 (that is, the output of the microphone 11 is subtracted from the output of the microphone 12). Hence, concerning the high-frequency range component, similar mixed outputs and frequency characteristics as those obtained by the previous devices can be obtained.

On the other hand, as far as the low-frequency range component is concerned, the output of the microphone 11 is not phase-inverted and added to the output of the microphone 12 as it is. Accordingly, when the wavelength of the incoming sound waves of the microphones 11 and 12 is in a low-frequency range large enough so that the distance D between the two microphones can be neglected, the outputs of the microphones 11 and 12 are added, which means that an output twice that of the microphones 11 or 12 can be obtained. Therefore, in this low-frequency range, a flat characteristic substantially identical to that of a primary unidirectivity microphone can be obtained, and there is no attenuation as seen in the above described previous devices, and unlike the known device described above, there is no attenuation. By varying the mixing ratio of the mixer 18, the directivity of the microphone device can be varied from primary to secondary unidirectivity.

If the phase characteristic of the phase-shifter 17 is designated by $\phi(\omega)$, the directivity pattern $P_1$ obtained by mixing the outputs of the microphones 11 and 12 can be described by the following equation:

$$P_1 = A \cdot \left(\frac{1+\cos\theta}{2}\right) \cdot e^{j(\omega t - \phi(\omega))} + B \cdot \left(\frac{1+\cos\theta}{2}\right) \cdot \quad (3)$$

-continued $$e^{j(\omega t - KD\cos\theta)}$$

When the sensitivities A and B, respectively, of the microphones 11 and 12 are identical (A=B), the above equation becomes:

$$P_1 = A \cdot \left(\frac{1+\cos\theta}{2}\right) \cdot e^{j\omega t} \cdot \{e^{-j\phi(\omega)} + e^{-jKD\cos\theta}\} \quad (4)$$

Here, in the equation (4), $$A \cdot \left(\frac{1+\cos\theta}{2}\right) \cdot e^{j\omega t} \text{ and } \{e^{-j\phi(\omega)} + e^{-jKD\cos\theta}\}$$

are respectively considered as a constant and a variable, the angular frequency $\omega_a$ lagging by 90 degrees in the phase-shifter 17 is set at 50 Hz, and the distance D=3 cm, and the angle $\theta=0$, 90 degrees are substituted to the above variable. The frequency characteristic and the directivity pattern obtained here are respectively shown in FIGS. 5 and 6. As clearly seen in FIGS. 5 and 6, in the high-frequency range, it shows a directivity characteristic substantially identical to that of a secondary unidirectivity microphone, and in the low-frequency range, it shows directivity characteristic substantially identical to that of a primary unidirectivity microphone. The degradation of the response as seen in the known devices is not seen in the low to intermediate frequency ranges, and the difference between the maximum and minimum values are in the range of 13.5 dB.

Figure 5:
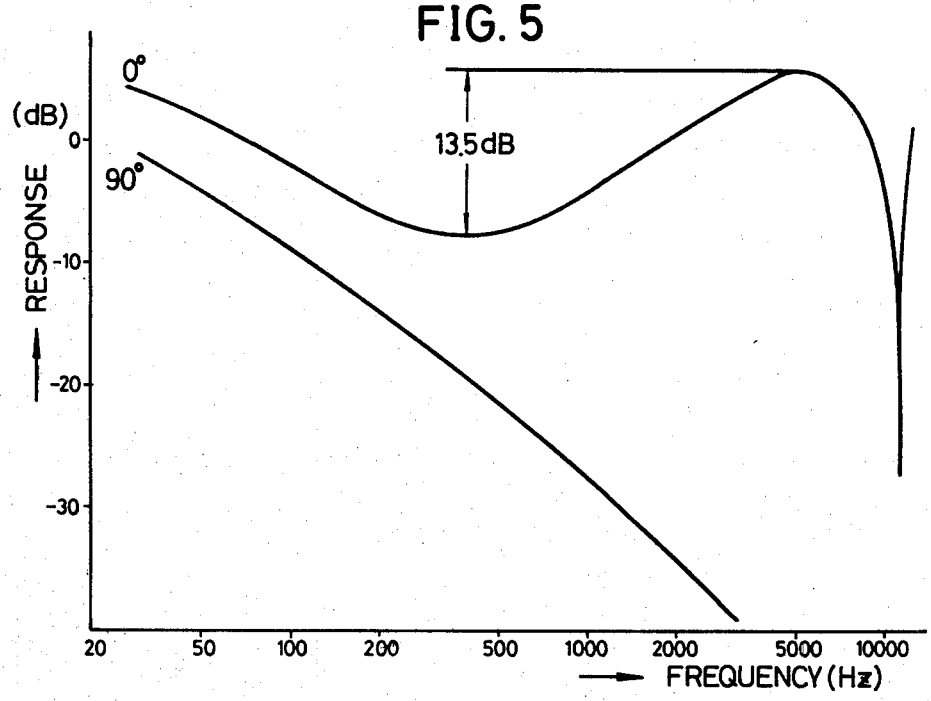
FIG. 5 is a graph showing the frequency characteristic of the output signal of a mixer in the systematic block diagram of FIG. 1.
Figure 6:
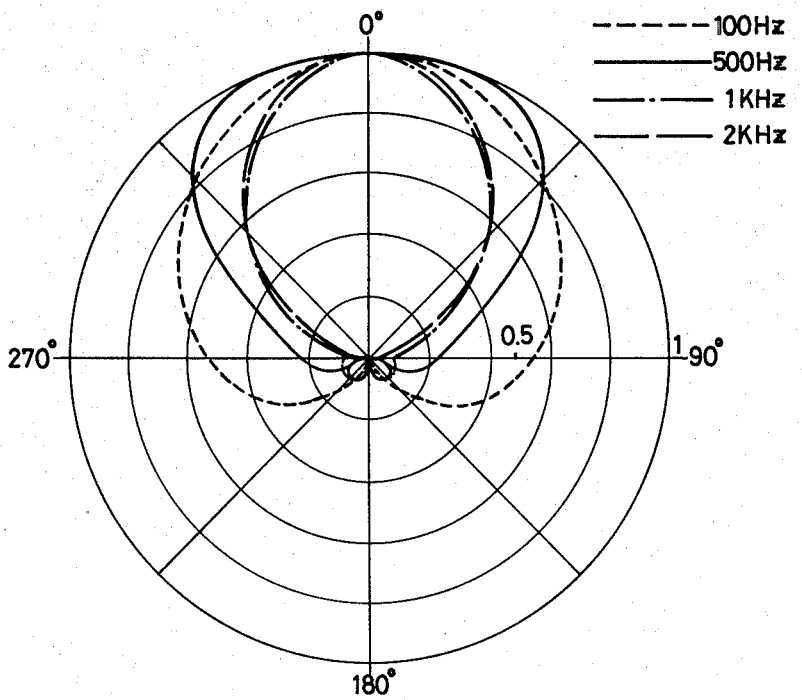
FIG. 6 is a graph showing the directivity characteristic of the device in FIG. 1.

Thus the correction characteristic of an equalizer 19 connected to the mixer 18 need only be a characteristic comprising an opposite characteristic to that shown in FIG. 5 where degradation in the range of 13.5 dB in the intermediate frequency range is corrected. The equalizer 19 is not required to possess a large correction quantity as in the previous devices, and the correction quantity can be small. As compared to before, the signal obtained from an output terminal 20 does not introduce degradation of the S/N ratio even in the intermediate to low frequency ranges, and sound noise, touch noise and the like is hardly produced.

Furthermore, according to the present invention, the outputs of both the microphones are added in the same phase in the low-frequency range, thus only a primary unidirectivity characteristic can be obtained. And, upon ordinary recording, in the low-frequency range of less than 200 Hz, the effect hardly differs in the recording when the recording is performed under the secondary unidirectivity or noise unidirectivity characteristics. As a result, there is no problem in the practical point of view, if in the low-frequency range, the device of the present invention is a primary unidirectivity device.

The phase-shifter 17 is not limited to the primary phase-shifter shown in FIG. 4, and can be secondary phase-shifter.

Figure 7:
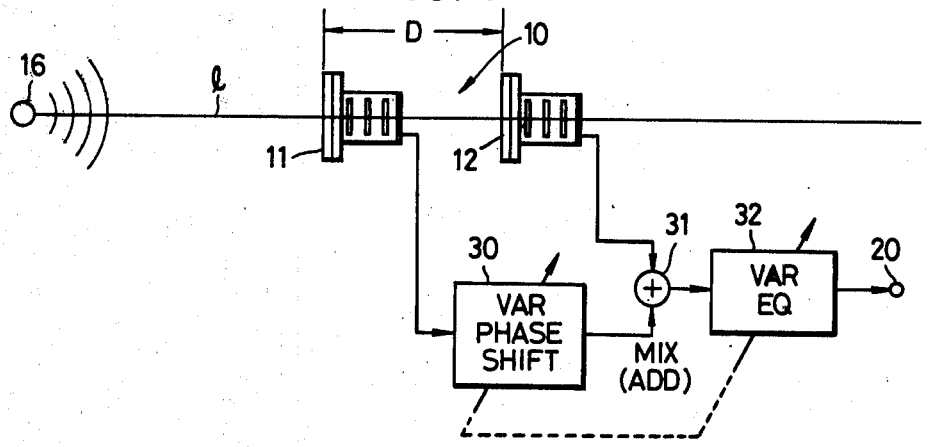
FIG. 7 is a systematic block diagram of a second embodiment of a variable-directivity microphone device of the present invention.

Next, a second embodiment of the present invention will be described in conjunction with FIG. 7 and the following. In FIG. 7, those parts which are the same as the corresponding parts in FIG. 1 are designated by like reference numerals, and their description of such parts will not be repeated.

The output of the microphone 11 is supplied to a mixer 31 through a variable primary phase-shifter 30, and mixed (added) with the output of the microphone 12 as it is. In this embodiment of the present invention, the mixer 31 is not organized to vary the mixing ratio.

Figure 8:
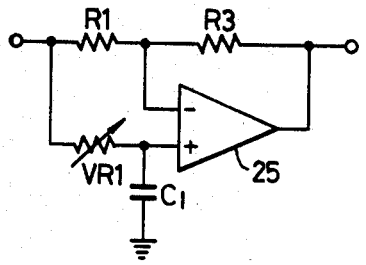
FIG. 8 is a circuit diagram showing one embodiment of a variable phase-shifter in the systematic block diagram of FIG. 7.

The phase-shifter 30 comprises, for example, an operational amplifier 25 connected as shown in FIG. 8, resistors $R_1$ through $R_3$, a variable resistor $VR_1$, and a capacitor $C_1$.

In the above stated equation (4), $\phi(\omega)$ can be described as:

$$\phi(\omega) = 2\tan^{-1}\frac{\omega}{\omega a}$$

Figure 10:
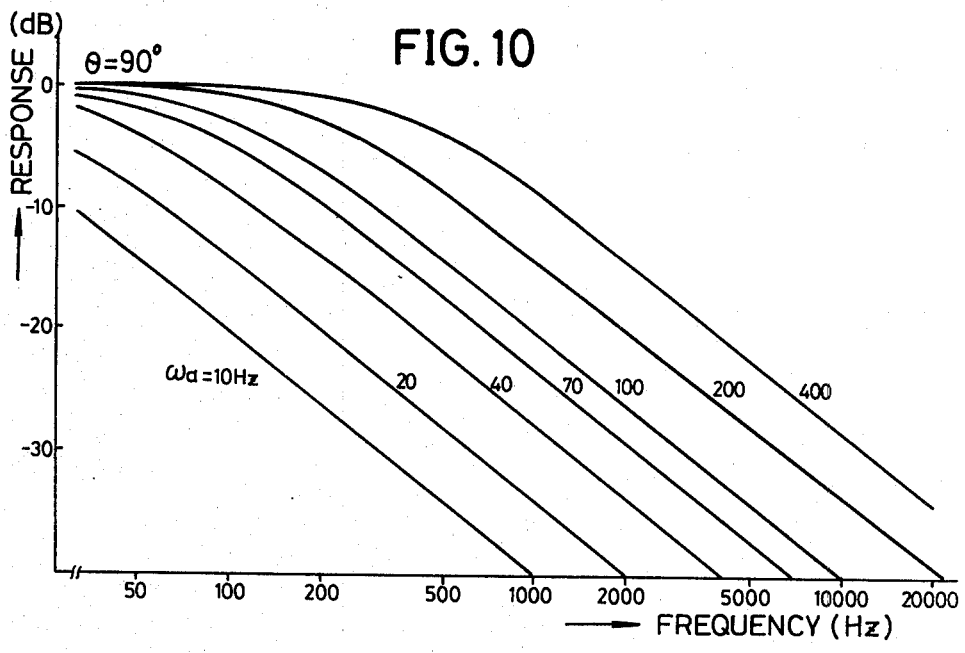
FIGS. 10 and 11 are, respectively, graphs showing the frequency characteristics of the device of FIG. 7 in the 90 degrees and 0 degree direction to the sound source.

Furthermore, in the equation (4), $$A \cdot \left(\frac{1+\cos\theta}{2}\right) \cdot e^{j\omega t}$$

and $\{e^{-j\phi(\omega)} + e^{-jKD\cos\theta}\}$ are respectively considered as a constant and a variable, the angular frequency $\omega_a$ lagging by 90 degrees in the variable phase-shifter 30 is varied from 10 Hz to 400 Hz by varying the resistance value of the variable resistor $VR_1$, and the distance D=3 cm, and the angle $\theta=0$, 90 degrees are substituted to the above variable. The frequency characteristics are shown in FIG. 10 ($\theta=0$) and FIG. 11 ($\theta=90$).

Figure 9:
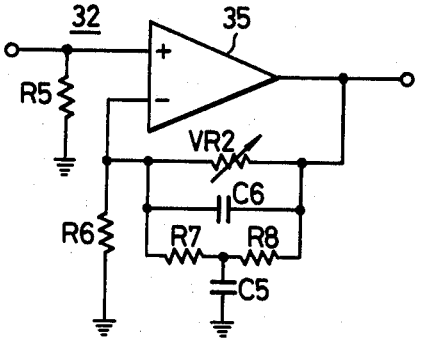
FIG. 9 is a circuit diagram showing one embodiment of a variable equalizer in the systematic block diagram of FIG. 7.

A variable equalizer 32 connected to the mixer 31 comprises, for example, an operational amplifier 35 connected as shown in FIG. 9, resistors $R_5$ through $R_8$, a variable resistor $VR_2$, and capacitors $C_5$ and $C_6$. The variable resistor $VR_2$ links with the the variable resistor $VR_1$ of the variable phase-shifter 30 shown in FIG. 8 and varied of its resistance value. With the change in the phase-shifting quantity of the variable phase-shifter 30 with respect to the resistance change of the variable resistor $VR_2$, the equalizing characteristic of the variable equalizer 32 changes with respect to the resistance change of the variable resistor $VR_2$. Therefore, even if the frequency characteristic changes with respect to the quantitive change in phase-shift of the variable phase-shifter 30, the output signal frequency characteristic can be corrected so as to be flat, by the variable equalizer 32.

Furthermore, in the circuit of FIG. 9, the capacitance of the capacitor $C_6$ is set at a capacitance more than ten times that of capacitor $C_5$, and the values of the capacitors $C_5$ and $C_6$ and the resistors $R_7$ and $R_8$ are set to that maximum correction quantity can be obtained at the maximum resistances of variable resistors $VR_1$ and $VR_2$.

Figure 11:
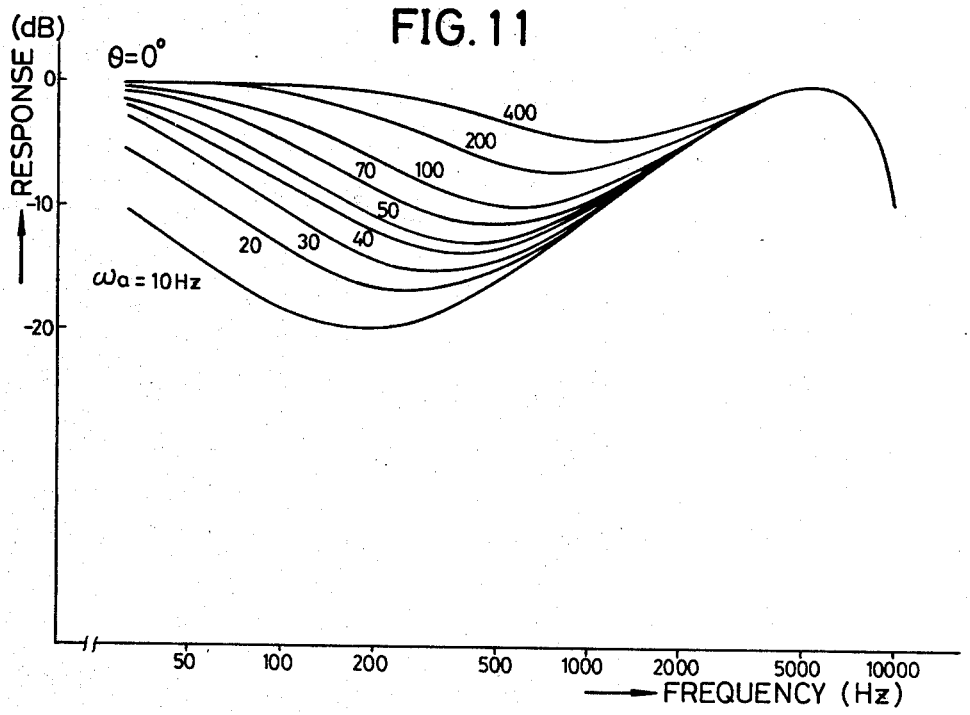

As clearly seen in FIG. 11, the frequency characteristic flattens as the angular frequency $\omega_a$ increases, thus approaching the flat frequency characteristic of a primary unidirectivity microphone. On the other hand, the frequency characteristic deviates from being flat as the angular frequency $\omega_a$ decreases, thus approaching to substantially identical frequency characteristics as those of the ordinary secondary unidirectivity microphones in the ordinary usage band range. Therefore, a desired directivity characteristic can be obtained by varying the phase-shift quantity in the variable phase-shifter 30. When this phase-shift quantity is continuously varied from $\omega_a=10$ Hz to $\omega_a=400$ Hz, the directivity characteristic can be varied in the primary unidirectivity to the secondary unidirectivity range.

Figure 12:
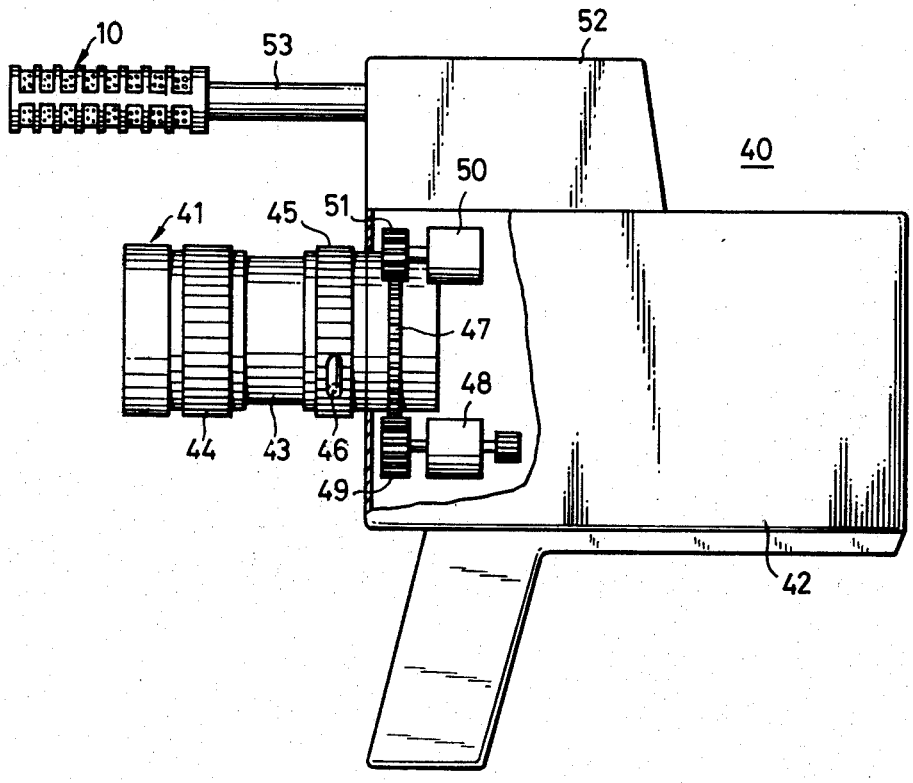
FIG. 12 is a side view, with parts cut away, of a television camera applied with a variable-directivity microphone device of the present invention.

An example of a television camera applied with a variable directivity microphone device of the present invention will now be described in conjunction with FIG. 12.

The television camera 40 has a zoom lens system 41 mounted on the front part of a camera body 42. This zoom lens system 41 comprises a fixed cylinder 43 containing the lens system, a distance matching ring 44, and a zoom ring 45. A zoom operating lever 46 is fixed to the zoom ring 45.

The zoom ring 45 is integrally formed with a rotating cylinder extending rearward into the camera body and supporting, in the camera body, a gear 47 fixed coaxially to the rotating cylinder. Also within the camera body 42, a gear 49 fixedly mounted on the rotor shaft of a drive motor 48 is meshed with the gear 47. A gear 51 fixedly mounted on the rotating shaft of a variable resistor, also accommodated within the camera body 42, is also meshed with the gear 47.

A housing 52 accommodating the above circuit is mounted on top of the camera body 42. This housing 52 fixedly supports a rod 53 directed straight forward and supports at its forward end a microphone unit accommodating cylinder 54.

When the zoom lens system is to be operated in zooming operation, the operator holds the lever 46 and directly rotates the zoom ring 45 in the case of manual operation. In the case of automatic operation, a switch is closed to supply electric power to the drive motor 48 and cause it to rotate. This driving rotation is transmitted via the gears 49 and 47 to rotate the zoom ring 45.

A variable resistor 50 comprises variable resistors $VR_1$ and $VR_2$. By manipulating the lever 46 or operating the motor 48, the zoom ring 45 is rotated, and zooming up is carried out. Together with the rotation of the zoom ring 45, the rotating shaft of the variable resistor 50 rotates, and the sliders of the variable resistors $VR_1$ and $VR_2$ undergo sliding displacement, and the resistance change, changing the directivity of the microphone device.

Figure 13:
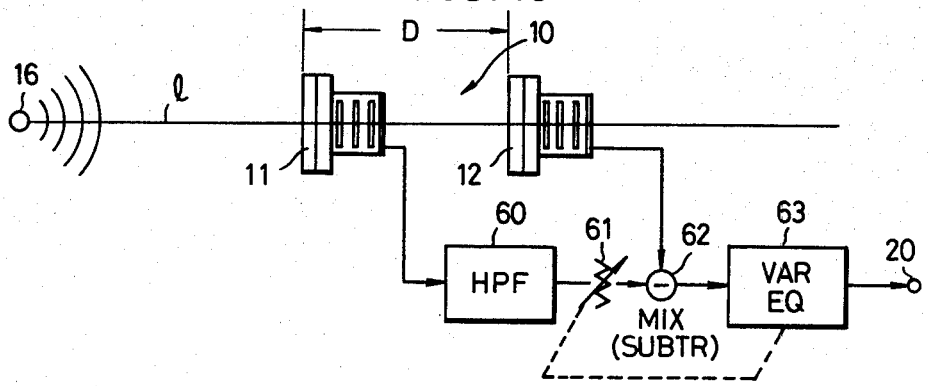
FIG. 13 is a systematic block diagram showing a third embodiment of a variable-directivity microphone device of the present invention.

A third embodiment of the present invention will now be described in conjunction with FIG. 13. The output signal of the microphone 11 is supplied to a mixer (subtraction device) 62 through a high-pass filter 60 and a variable resistor 61, and mixed to (subtracted from) the output signal of the microphone 12.

The high-pass filter 60 has, for example, an attenuation characteristic in which the cut-off frequency is 100 Hz and the deviation is 6 dB/oct. The signal having its low-frequency component attenuated by way of the high-pass filter 60 is provided to the mixer 62 after undergoing level adjustment by the variable resistor 61.

Here, when the resistance of the variable resistor 61 is adjusted to the maximum value, the output of the microphone 11 is not attenuated by the high-pass filter 60 in the high-frequency range where the frequency is higher than that of the cut-off frequency of the high-pass filter 60, and subtracted from the output of the microphone 12 in the same phase and level. Therefore, the high-frequency range component of the output of the microphone 11 is phase-inverted and added to the output of the microphone 12, and hence the same effect is obtained as that obtained in the first embodiment of the present invention.

On the other hand, of the output of the microphone 11, the low-frequency range component which is lower than the cut-off frequency of the high-pass filter 60 is attenuated by the high-pass filter 60 and mixed with the output of the microphone 12, and in reality, as far as the low-frequency range component is concerned, only the output of the microphone 12 is obtained. Accordingly, in the low-frequency range, the frequency characteristic is flat comprising no attenuation, and substantially identical to that of a primary unidirectivity microphone.

If the phase characteristic of the high-pass filter 60 is designated by $\phi(\omega)$, the output $P_2$ obtained by attenuating the output of the microphones 11 and 12, including the high-pass filter 60, can be described by the following equation:

$$P_2 = A \cdot \left(\frac{1+\cos\theta}{2}\right) \cdot e^{j(\omega t+\phi(\omega))} - B \cdot \left(\frac{1+\cos\theta}{2}\right) \cdot e^{j(\omega t - KD\cos\theta)} \quad (5)$$

$$\text{Here, } A = \frac{\frac{\omega}{\omega_c}}{\sqrt{1+\left(\frac{\omega}{\omega_c}\right)^2}}, \quad \phi = \tan^{-1}\left(\frac{1}{\frac{\omega}{\omega_c}}\right)$$

As the resistance of the variable resistor 61 is varied from the maximum to the minimum value, the output level of the microphone 11 decreases, and at the minimum resistance value, the output consists only of the output of the microphone 12. Accordingly, by varying the resistance of the variable resistor 61 and varying the sensitivity ratio between the sensitivity A of the microphone 11 and sensitivity B of the microphone 12 of the equation (5) including the high-pass filter 60, a secondary directivity can be obtained when the resistance of the variable resistor 61 is at maximum value, and a primary directivity can be obtained when the resistance of the resistor 61 is at minimum value, hence being continuously variable in the range between the primary directivity and secondary directivity range.

Figure 14:
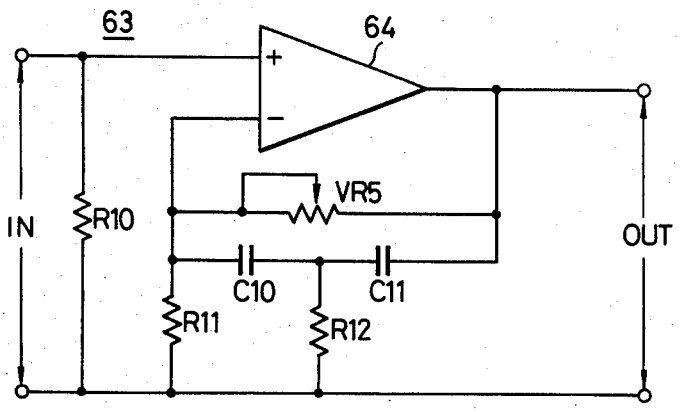
FIG. 14 is a circuit diagram showing one example of a variable equalizer in the systematic block diagram of FIG. 13.

The output of the mixer 62 is obtained from the terminal 20 through the variable equalizer 63. The variable equalizer 63 comprises, for example, an operational amplifier 64, resistors $R_{10}$ through $R_{12}$, a variable resistor $VR_5$, and capacitors $C_{10}$ and $C_{11}$ as shown in FIG. 14. The variable resistor $VR_5$ is linked to the variable resistor 61 and varied, and with the variation of the mixing level, the equalizing characteristic due to the variable equalizer 63 is varied. Furthermore, when the resistance of the variable resistor is of minimum value, the variable resistor $VR_5$ is organized to have the minimum resistance. The correction characteristic according to the frequency characteristic when $\theta=0$ degree in the intermediate and high frequency range is determined by capacitors $C_{10}$ and $C_{11}$, a resistor $R_{12}$, and the variable resistor $VR_5$, and the correction characteristic according to the low-frequency range is determined by capacitors $C_{10}$ and $C_{11}$, resistors $R_{11}$ and $R_{12}$, and the variable resistor $VR_5$.

Figure 15:
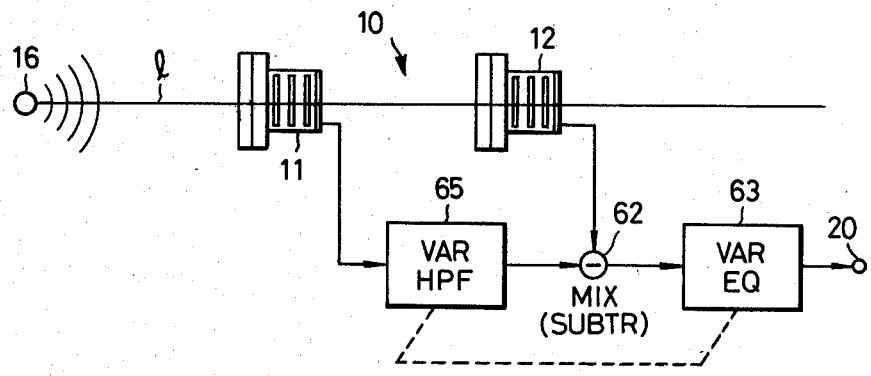
FIG. 15 is a systematic block diagram showing a fourth embodiment of a variable-directivity microphone device of the present invention.

A fourth embodiment of the present invention will now be described in conjunction with FIG. 15. In FIG. 15, those parts which are the same as the corresponding parts in FIGS. 1 and 13 are designated by like reference numerals, and their descriptions of such parts will not be repeated. In this embodiment of the present invention, a variable high-pass filter 65 is used instead of the high-pass filter 60 and the variable resistor 61 in FIG. 13 of the third embodiment.

Figure 16:
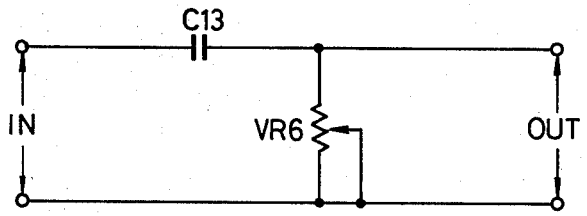
FIG. 16 is a circuit diagram showing one embodiment of a variable high-pass filter circuit in the systematic block diagram of FIG. 15.

The variable high-pass filter 65 comprises, for example, a capacitor $C_{13}$ and a variable resistor $VR_6$ as shown in FIG. 16. By varying the resistance of the variable resistor $VR_6$, the cut-off frequency of the variable high-pass filter 65 is varied in the range of 50 Hz to 10 kHz.

When the cut-off frequency of the variable resistor $VR_6$ is low, the outputs of the microphones 11 and 12 are in reality subtracted within a large frequency range, and secondary directivity is obtained. On the other hand, when the cut-off frequency is high, the output of the microphone 12 is obtained in reality on a large scale in relation to the output ratio of the microphone 11 over a large frequency range, and hence primary unidirectivity is obtained. Accordingly, accompanied with the change in the variable $VR_6$, the directivity can be continuously varied from the primary to secondary unidirectivity range.

In each of the above embodiments, the microphone unit 10 is organized to employ two microphones. However, as described in United States Patent Application Ser. No. 142,845 entitled "Variable-Directivity Microphone Device", the microphone unit 10 may be organized to employ three microphones.

Further, this invention is not limited to these embodiments but various variations and modifications may be made without departing from the scope of the invention.

What is claimed is:

1. A variable-directivity microphone device comprising:

a microphone unit having a plurality of microphones;

means in which the low-frequency range components of the output signal of one of said microphones of said microphone unit is resultingly added and mixed with the output signal of the other microphone and only the high-frequency range components are resultingly cancelled each other, said mixing means being capable of varying the mixing conditions; and equalizer means for correcting the characteristic of said mixed signal.

2. A variable-directivity microphone device comprising:

a microphone unit having a plurality of microphones;

a phase-shifter supplied with the output signal of one of said microphones of said microphone unit, which leaves the low-frequency range components as they are and shifts the phase of the high-frequency range components towards the −180 degrees direction;

mixing means for adding and mixing the output signal of said phase-shifter and the output signal of the other microphone of said microphone unit, said mixing means being capable of varying the mixing ratio; and equalizer means for correcting the characteristic of the output signal of said mixing means.

3. A variable-directivity microphone device comprising:

a microphone unit having a plurality of microphones;

a variable phase-shifter supplied with the output signal of one of said microphones of said microphone unit, which leaves the low-frequency range components as they are and shifts the phase of the high-frequency range components towards the −180 degrees direction, said variable phase-shifter being varied of its phase characteristic;

mixing means for adding and mixing the output signal of said phase shifter and the output signal of the other microphone of said microphone unit; and equalizer means for correcting the characteristic of the output signal of said mixing means.

4. A variable-directivity microphone device as described in claim 3 in which said equalizer means is organized so that the correction characteristic can be varied, and said variable phase-shifter and said variable equalizer means are linked and varied.

5. A variable-directivity microphone device comprising:

a microphone unit having a plurality of microphones;

a high-pass filter supplied with the output signal of one of said microphones, said high-pass filter passing the high-frequency range components of said output signal;

mixing means for subtracting and mixing the output signal of said high-pass filter from the output signal of the other microphone of said microphone unit, said mixing means being varied of its mixing ratio; and equalizer means for correcting the characteristic of the output signal of said mixing means.

6. A variable-directivity microphone device as described in claim 5 in which said equalizer means is organized so that the correction characteristic can be varied, and said mixing means and said equalizer means are linked and varied.

7. A variable-directivity microphone device comprising:

a microphone unit having a plurality of microphones;

a variable high-pass filter supplied with the output signal of one of said microphones of said microphone unit, said variable high-pass filter passing the high-frequency range components of said output signal, said variable high-pass filter being varied of its passing characteristic;

mixing means for subtracting and mixing the output signal of said variable high-pass filter from the output of the other microphone; and variable equalizer means for correcting the characteristic of the output signal of said mixing means, said variable equalizer means and said variable high-pass filter being linked and varied.

* * * * *